US008283865B2

(12) United States Patent
Morimoto

(10) Patent No.: US 8,283,865 B2
(45) Date of Patent: Oct. 9, 2012

(54) EXCIMER DISCHARGE LAMP AND METHOD OF MAKING THE SAME

(75) Inventor: Yukihiro Morimoto, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 163 days.

(21) Appl. No.: 12/591,096

(22) Filed: Nov. 9, 2009

(65) Prior Publication Data

US 2010/0123394 A1 May 20, 2010

(30) Foreign Application Priority Data

Nov. 18, 2008 (JP) ..... 2008-294352

(51) Int. Cl.
*H01J 17/16* (2012.01)

(52) U.S. Cl. ..... 313/634; 445/33

(58) Field of Classification Search ..... 313/634; 445/33

See application file for complete search history.

(56) References Cited

U.S. PATENT DOCUMENTS 4,945,290 A 7/1990 Eliasson et al.
6,249,086 B1 6/2001 Honda et al.
2001/0008365 A1 7/2001 Honda et al.
2009/0096377 A1* 4/2009 Mizojiri et al. ..... 313/635

FOREIGN PATENT DOCUMENTS

| | | | |
|---|---|---|---|
| JP | 03-115200 | A | 5/1991 |
| JP | 06-310106 | A | 11/1994 |
| JP | 7-057701 | A | 3/1995 |
| JP | 10-064481 | A | 3/1998 |
| JP | 2849602 | B2 | 11/1998 |
| JP | 11-012099 | A | 1/1999 |
| JP | 2005-276640 | A | 10/2005 |

* cited by examiner

*Primary Examiner* — Joseph L Williams
*Assistant Examiner* — Brenitra Lee
(74) *Attorney, Agent, or Firm* — Rader, Fishman & Grauer PLLC

(57) ABSTRACT

An excimer discharge lamp includes an electric discharge container having a pair of plates which face each other and connected by a side wall. An electrical discharge space is formed between the plates. A pair of external electrodes are provided on exterior surfaces of the plates. A light emission gas of rare gas, halogen or halide is enclosed in the electrical discharge space. The pair of plates and the side wall are made of sapphire, YAG, or single crystal yttria. Impurities which exist in an inner surface of the electric discharge container surrounding the electrical discharge space contain at least silicon, carbon, or cerium, and the quantity thereof is 0.6 ng/cm$^2$ or less.

5 Claims, 7 Drawing Sheets

FIG.4A
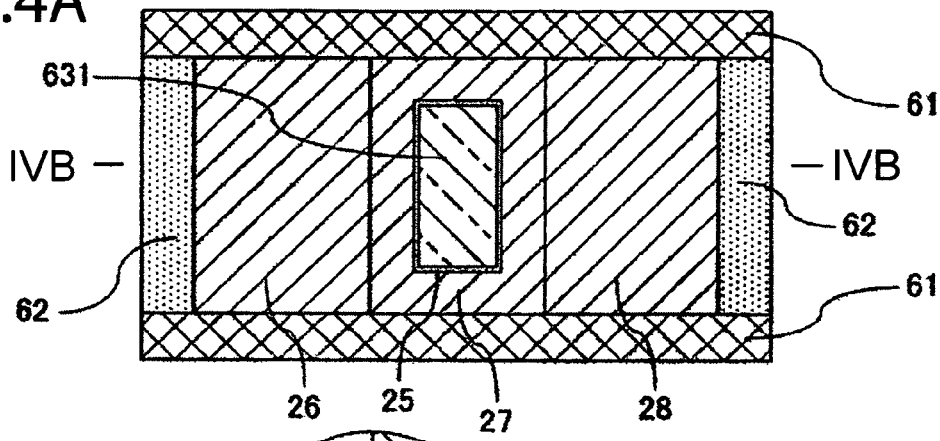
FIG.4B
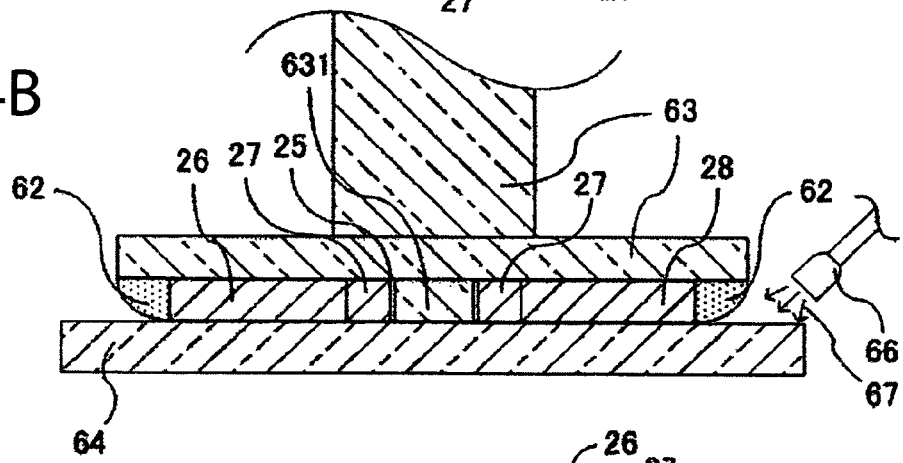
FIG.4C
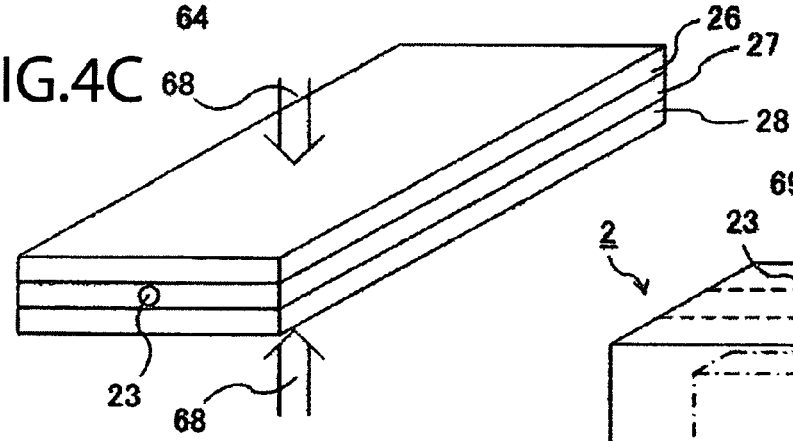
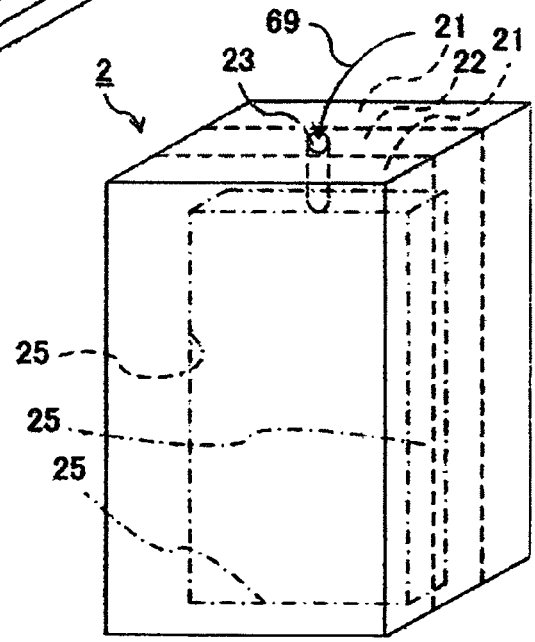
FIG.4D

Time during which the relative intensity with respect to initial light intensity at time of initial lighting decreases to 50 % thereof

EXCIMER DISCHARGE LAMP AND METHOD OF MAKING THE SAME

This application claims priority from Japanese Patent Application Serial No. 2008-294352 filed Nov. 18, 2008, the contents of which are incorporated herein by reference in its entirety.

TECHNICAL FIELD

The present invention relates to an excimer discharge lamp which emits ultraviolet rays by excimer electric discharge. In particular, the present invention relates to an excimer discharge lamp in which an electric discharge container has a pair of plates which are arranged so as to face each other.

BACKGROUND

In the conventional use of photochemical reaction such as optical cleaning, surface modification and sensitization of a chemical substance, an excimer discharge lamp is used as a light source for ultraviolet rays. For example, rare gas such as xenon, and halide such as fluoride are enclosed as gas for light emission of the excimer discharge lamp. The halogen or halide is ionized at time of lamp lighting, so that halogen ions are formed, whereby the reactivity with other substances becomes very high. For this reason, the electric discharge container of the excimer discharge lamp needs to be devised so that the halogen or halide can be enclosed. Moreover, in the use of photochemical reaction, instead of an annular excimer discharge lamp which is often used to process a workpiece having a flat face by irradiation, an excimer discharge lamp which can perform face irradiation is desirable in view of capable of controlling light intensity distribution unevenness. For this reason, it is necessary to devise the electric discharge container of the excimer discharge lamp, so that face irradiation can be performed. An excimer discharge lamp disclosed in, for example, Japanese Patent Application Publication No. 06-310106 is conventionally known to fulfill such conditions.

FIG. 6 is an explanatory diagram of a conventional excimer discharge lamp 100, and is a cross sectional view thereof taken along the central axis of disk-like window members 101. The conventional excimer discharge lamp 100 comprises the window members 101 which consists of a pair of disk like shape plates, a pair of electrodes 102 which are provided on the respective exterior surfaces of the pair of window members 101, a electrical discharge space spacer 109 which is arranged between the pair of window members 101, sealing portion materials 105 respectively provided between the window members 101 and the electrical discharge space spacer 109, a pair of metallic members 106 which are respectively in contact with circumferential end faces of the window members 101, and which hold the window members 101 therebetween, bolts 107 which are inserted in respective through holes which pass through the metallic members 106 and the electrical discharge space spacer 109, and a pair of nuts which are respectively provided in both ends of the bolts 107, and which hold the exterior surfaces of the pair of window members.

In the conventional excimer discharge lamp 100, when the pair of window members 101 is held by the bolts 107 and the nuts, the window members 101 and the electrical discharge space spacer 109 are sealed by the sealing portion materials 105 therebetween. Thus, in the excimer discharge lamp 100, an electrical discharge space 104 is formed by the pair of window members 101, the electrical discharge space spacer 109, and the sealing portion materials 105. In the electrical discharge space 104, rare gas such as krypton (Kr) and xenon (Xe) and halogen such as fluorine ($F_2$) and chlorine ($Cl_2$) are enclosed as gas for light emission.

Since halogen gets in contact with these members which form the electrical discharge space 104, material having low reactivity with halogen is adopted therefore. Specifically, when the window members 101 are made of sapphire ($Al_2O_3$) or metal oxides other than silicon, such as single crystal yttria ($Y_2O_3$), it is possible to prevent the window members 101 from deteriorating. Moreover, the sealing portion materials 105 are made from O-rings having low reactivity with halogen, such as perfluoroelastomeror or fluorine contained resin.

In the conventional excimer discharge lamp 100, excimer electric discharge is caused in the electrical discharge space 104 by supplying high voltage of high frequency between the pair of electrodes 102. For example, when the gas for light emission consists of krypton and fluorine, ultraviolet rays having a wavelength band of 240 nm-255 nm are obtained. Moreover, when the gas for light emission consists of xenon and chlorine, ultraviolet rays of a wavelength band of 300 nm-320 nm are obtained. The ultraviolet rays produced in the electrical discharge space 104 pass through the window members 101, and are emitted to the outside from the mesh of the electrodes 102 which are made up of a metal net. Since the window members of the excimer discharge lamp 100 are plates, face irradiation can be performed from the exterior surface of the window members, so that a workpiece to be irradiated (not shown), which faces the window members, can be suitably processed.

SUMMARY

However, in the conventional excimer discharge lamp 100, there is a problem that the life span thereof is short, that, is, time (the so-called life span) during which the relative intensity with respect to the initial light intensity at time of initial lighting decreases to 50% thereof, is only several hours. It is thought that this short life problem is attributed to outflow of the gas for light emission due to degradation of the sealing portion materials 105. Specifically, heat produced due to electric discharge which occurs between the pair of electrodes, is transferred to the sealing portion materials 105, so that the sealing portion materials 105 become high in temperature, thereby resulting in deterioration thereof. It is thought that the deteriorated sealing portion materials 105 cannot maintain the airtightness of the electrical discharge space 104, so that the gas for light emission, which is enclosed in the electrical discharge space 104, flows outside, whereby such a short life span problem occurs.

The conventional electric discharge container comprises the pair of plate window members 101, the electrical discharge space spacer 109, the sealing portion materials 105, the pair of metallic members 106, the bolts 107, and the nuts. In order to solve the short life problem, the electrical discharge space 104 may be formed, without using the sealing portion materials 105. In case where the components which form the plate window members 101 are made of sapphire, Japanese Patent No. 2849602 and Japanese Patent Application Publication No. H11-012099 teach the technology in which material members made of sapphire are joined to each other. The inventors tried to make an electric discharge container, using the technology disclosed in Japanese Patent No. 2849602 and Japanese Patent Application Publication No. H11-012099.

FIG. 7 is an explanatory perspective view of a novel electric discharge container which the present inventor examined. As shown in FIG. 7, the electric discharge container is made of three rectangular parallelepiped-shaped plates 26, 27, and 28. These three plates 26, 27, and 28 can be made by, for example, carving out sapphire material. A hole is provided in the plate 27 located in the center of FIG. 7 among the three plates 26, 27, and 28, thereby forming an annular side wall member, whereby an inner surface 28 which forms the electrical discharge space may be formed.

At least surfaces of the three plates 26, 27, and 28 where another face is joined, are ground. Specifically, surfaces of the three plates set forth below are ground. As for one of the plates which is located in an upper side of FIG. 7, a surface of a lower side thereof in FIG. 7 (a surface which faces the side wall member) is ground. Moreover, as for the side wall member located in the center of FIG. 7, a surface of an upper side thereof in FIG. 7 (a surface which faces the one of the plate members) and a surface of a lower side thereof in FIG. 7 (a surface which faces the other plate member side) are ground. As for the other plate member which is located in a lower side of FIG. 7, a surface of an upper side thereof in FIG. 7 (a surface which faces the side wall member) is ground.

The plates are respectively laminated so that the ground surfaces are brought into contact with each other, and are pressed so as to be held from both upper and lower sides of FIG. 7. While the plates are respectively pressed, they are heated at 1,000 degrees Celsius or higher in a reduced pressure environment. Each plate is cooled down to even room temperature after a predetermined time heating.

After cooling, the surfaces which are brought into contact with each other are respectively joined, so that the laminated plates are integrally formed, without pressing them. This integrated member can be used as the electric discharge container. The electrical discharge space formed by the inner surface of the one of the plate members, the inner surface of the other plate member, and the inner surface of the side wall member, which were members before joining them, is provided inside the electric discharge container.

Thus, even if the sealing portion materials are not provided, a box-shaped electrical discharge space is formed in the inside thereof, while the novel electric discharge container that the present inventor examined, has a pair of plates (which correspond to the one of the plate members and the other plate member before joining them).

When an excimer discharge lamp was formed using this novel electric discharge container, it was not possible to solve the problem of the short life span, that is, the problem that time (the so-called life span) during which the relative intensity with respect to the initial light intensity at time of initial lighting decreases to 50%, is only several hours. It is thought that the cause was attributed to abrading agent, when the present inventor studied the cause of the short life problem of the excimer discharge lamp formed from the novel electric discharge container. Specifically, it is considered that the abrading agent remained on the inner surface which formed the electrical discharge space, when the three plates were ground with abrading agent such as silicon dioxide ($SiO_2$) silicon carbide (SiC), diamond (C), and cerium oxide ($CeO_2$). When this abrading agent remained on the electrical discharge space, it reacted with halogen or halide of the gas for light emission in the lamp lighting progress, thereby producing a compound therewith. Therefore, it is considered that the life span thereof was shortened when the quantity of halogen ions which contributed to excimer discharge decreases.

As disclosed in Japanese Patent No. 2849602, since there is contamination by organic substance, dust, etc., it is cleaned by detergent, isopropyl alcohol, etc. after grinding. However, the abrading agent cannot be removed with such chemicals. That is, in the technology disclosed in Japanese Patent No. 2849602 and Japanese Patent Application Publication No. H11-012099, an integrated member which is obtained by joining sapphire materials to each other, is not considered to be used for an electric discharge container of an excimer discharge lamp etc. Consequently, it was not conventionally known that there is a short life problem resulting from abrading agent in this electric discharge container.

Therefore, it is an object of the present invention to offer an excimer discharge lamp and a method of making the excimer discharge lamp, whose life span is longer than that of the conventional excimer discharge lamp.

One of aspects of the present invention is an excimer discharge lamp comprising an electric discharge container having a pair of plates which face each other through an electrical discharge space, and a pair of external electrodes provided on exterior surfaces of the pair of plates, wherein gas for light emission is enclosed in the electrical discharge space and consists of at least rare gas and halogen, or halide, wherein the electrical discharge space of the electric discharge container is sealed by the pair of plates, a side wall which connects the pair of plates, wherein the pair of plates and the side wall are made of sapphire, YAG, or single crystal yttria, wherein impurities which exist in an inner surface of the electric discharge container surrounding the electrical discharge space contain at least silicon, carbon, or cerium, and the quantity thereof is 0.6 $ng/cm^2$ or less.

Another aspect of the present invention is a manufacture method of an excimer discharge lamp comprising an electric discharge container including a pair of plates which face each other through an electrical discharge space, and a pair of external electrodes provided on exterior surfaces of the pair of plates, wherein gas for light emission is enclosed in the electrical discharge space and consists of at least rare gas and halogen, or halide, wherein the manufacturing method comprises a step of grinding surfaces of the pair of plates and an annular side wall, which are made of sapphire, YAG, or single crystal yttria, a step of arranging the side wall member between the pair of plates, after the step of grinding the surfaces, a step of joining the ground surfaces by heating while pressing the ground surfaces to each other, so that the electric discharge container having the electrical discharge space is formed by the pair of plates and the side wall member by the step of joining the ground surfaces, a step of introducing chemical etching liquid from a through hole which leads to the electrical discharge space of the electric discharge container, thereby cleaning an inner surface of the electric discharge container.

According to the above-mentioned features of the excimer discharge lamp in the first aspect of the present invention, since the electric discharge container is made of sapphire, YAG, or single crystal yttria having low reactivity with halogen ions, and since the reaction of the impurities which contain at least silicon, carbon, or cerium with the halogen ions enclosed in the electrical discharge space can be suppressed, it is possible to make the life span thereof, longer than that of the conventional excimer discharge lamp. According to the above-mentioned features of the manufacturing method of an excimer discharge lamp in the second aspect of the present invention, since the electric discharge container can be formed by sapphire, YAG, or single crystal yttria having low reactivity with halogen, and since impurities which exist on an inner surface of the electric discharge container and which contain at least silicon, carbon, or a cerium, can be dissolved with chemical etching liquid, it is possible to make the life span thereof longer than that of the conventional excimer discharge lamp.

BRIEF DESCRIPTION OF DRAWINGS

Other features and advantages of the present excimer discharge lamp and a method of making the same will be apparent from the ensuing description, taken in conjunction with the accompanying drawings, in which:

FIG. 4A is a top plan view showing a manufacturing method, in which a pair of plates and a side wall member are fixed to a jig;

FIG. 4B is a cross sectional view thereof, taken along IVB-IVB of FIG. 4A, showing a process of grinding a pair of plates and a side wall member;

FIG. 4C is a perspective view thereof, showing a process of heating while pressing the pair of plates and a side wall member after grinding them;

FIG. 4D is a perspective view thereof, showing a process of cleaning inner surfaces of an electric discharge container with chemical etching liquid;

DESCRIPTION

Figure 1:
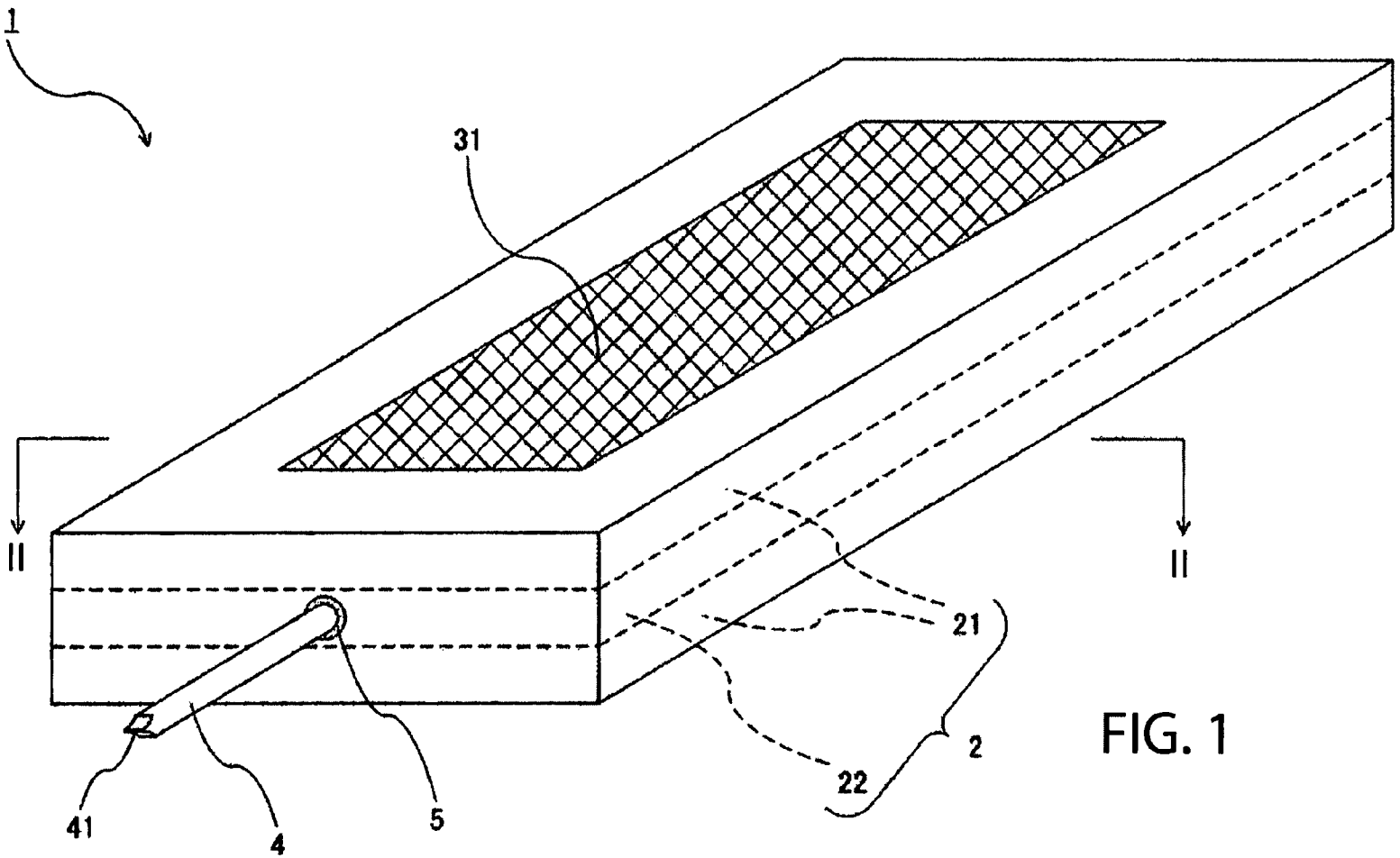
FIG. 1 is an explanatory diagram of an excimer discharge lamp according to a first embodiment.
Figure 2:
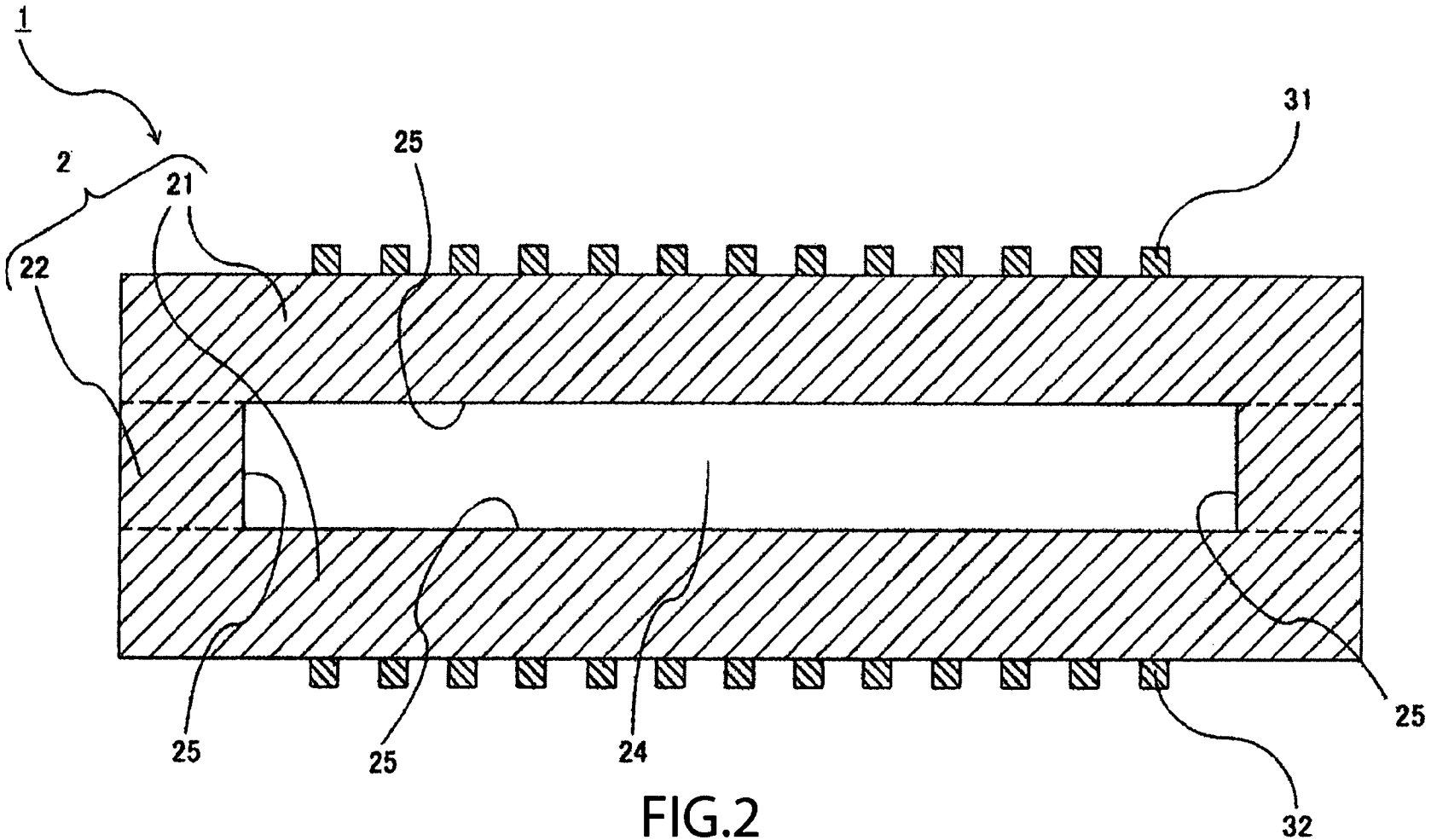
FIG. 2 is an explanatory diagram of an excimer discharge lamp according to a first embodiment.

A first embodiment according to the present invention will be described, referring to FIGS. 1 and 2. FIG. 1 is an explanatory perspective view of an excimer discharge lamp 1 according to the first embodiment. FIG. 2 is a cross sectional views of the excimer discharge lamp, taken in a direction orthogonal to a longitudinal direction of the excimer discharge lamp 1 of FIG. 1 (a cross sectional view thereof taken along a line II-II of FIG. 1).

The excimer discharge lamp 1 according to the first embodiment includes an electric discharge container 2 which is made of sapphire (single crystal alumina $Al_2O_3$), YAG (yttrium aluminum garnet), or single crystal yttria ($Y_2O_3$), and a pair of external electrodes 31 and 32 provided on the exterior surface of a pair of plates 21 which form the electric discharge container 2, wherein gas for light emission enclosed in an electrical discharge space 24 of the inside of the electric discharge container 2, consists of at least rare gas and halogen, or halide.

The electric discharge container 2 comprises the pair of rectangular parallelepiped-shaped plates 21, and an annular side wall 22 which is located between the pair of plates 21 and which connects the pair of plates 21 therethrough. Thereby, the electric discharge container 2 is formed in the shape of a rectangle in a cross sectional view thereof taken in a direction orthogonal to the plates 21. In the electric discharge container 2, the electrical discharge space 24 is surrounded by the inner surfaces 25 of the pair of plates 21 which face each other, and inner surfaces 25 of the annular side wall 22 (left and right side inner surfaces 25 in FIG. 2 and front and back side inner surfaces 25 (not shown)). In the inner surfaces 25 of the electric discharge container 2, the quantity of the impurities which contain at least silicon (Si), carbon (C), or cerium (Ce) may be 0.6 ng/cm$^2$ or less. In addition, in FIGS. 1 and 2, for convenience of explanation, dotted lines are shown on the electric discharge container 2 in order to clearly show the pair of plates 21 and the side wall 22. However, in the electric discharge container 2 joined by a manufacture method described below, the boundaries of the pair of plates 21 and the side wall 22 cannot be seen and the dotted lines shown in FIGS. 1 and 2 do not exist actually.

A through hole which leads to the internal electrical discharge space 24 is formed in the side wall 22 of the electric discharge container 2. A metal tube member 4 is provided in the through hole. The tube member 4 is bonded therein by a wax material 5 made of an alloy of silver and copper (Ag—Cu alloy) which is provided between the through hole and the tube member 4. This tube member 4 has a hole which extends in the central axis thereof, and this hole leads to the electrical discharge space 24. As gas for light emission, rare gas such as argon (Ar), krypton (Kr), and xenon (Xe), and halogen such as fluorine (F2), chlorine ($Cl_2$), bromine ($Br_2$), and iodine ($I_2$) or halide such as sulfur hexafluoride ($SF_6$) are enclosed through the hole of the tube member 4 into the electric discharge space 24. A sealing portion 41 is formed by a pressure welding at one end of the tube member 4 (an end portion in a front side of FIG. 1), so that the inside of the electrical discharge space 24 is airtightly sealed.

In the electric discharge container 2, the external net-like electrodes 31 and 32 are respectively provided on exterior surfaces of the pair of the plates 21 (surfaces opposite to the inner side of the electrical discharge space 24). As shown in FIG. 1, these external electrodes 31 and 32 are provided so as to extend along with the longitudinal direction of the plates 21. Moreover, as shown in FIG. 2, the external electrodes 31 and 32 are apart from each other so as not to electrically connect to each other, and are arranged to face each other through the pair of plates 21, and the electrical discharge space 24.

In the excimer discharge lamp 1 according to the first embodiment, a power supply (not shown) is electrically connected to the pair of external electrodes 31 and 32, and lamp lighting is started by supplying high voltage of high frequency therebetween.

In the excimer discharge lamp 1, the electric discharge container 2 functions as dielectrics when the high voltage of high frequency is supplied to the pair of external electrodes 31 and 32, and electric discharge occurs between the pair of external electrodes 31, and 32. When the gas for light emission consists of rare gas such as argon (Ar) and halide such as sulfur hexafluoride ($SF_6$), in the electrical discharge space 24, they are ionized and argon ions and fluorine ions are formed, so that the excimer molecules which consist of argon-fluorine are formed and ultraviolet rays with wavelength of 193 nm are produced. Since the sapphire (single crystal alumina $Al_2O_3$), YAG (yttrium aluminum garnet), or single crystal yttria ($Y_2O_3$) which forms the electric discharge container 2 has a ultraviolet-rays permeability, the ultraviolet rays produced in the electrical discharge space 24 pass through the electric discharge container 2. Since the external electrodes 31 and 32 provided on the pair of exterior surfaces of the electric discharge container 2 are made up of a net-like member, the ultraviolet rays are emitted to the outside thereof from the mesh. Since excimer electric discharge is suitably performed between the pair of external electrodes 31, and 32, ultraviolet rays suitably pass through the pair of plates 21 on which the pair of external electrodes 31 and 32 are provided. That is, the excimer discharge lamp 1 according to the first embodiment functions well as a surface light source in which ultraviolet rays suitably pass through the plates 21, so that it is possible to suitably process a workpiece to be irradiated (not shown), which is placed to face the plate 21.

The electric discharge container 2 of the excimer discharge lamp 1 according to the first embodiment is made of the sapphire (single crystal alumina $Al_2O_3$), YAG (yttrium aluminum garnet), or single crystal yttria ($Y_2O_3$), wherein these materials have lower reactivity with halogen or halide than, for example, quartz glass which consists of an oxide of silicon. The electrical discharge space 24 of the excimer discharge lamp 1 according to the first embodiment in which excimer electric discharge occurs, is formed by directly joining material having low reactivity with halogen or halide (the pair of plates 21 and the side wall 22) to each other. Moreover, an abrading agent 67 is used in a process of a method of making an electric discharge container 2, which is described below. However, the abrading agent 67 contains at least silicon (Si), carbon (C), or cerium (Ce), so that these elements have very high reactivity with halogen or halide. For this reason, in the excimer discharge lamp 1 according to the first embodiment, the quantity of impurities which exist in the inner surfaces 25 of the electric discharge container 2 forming the electrical discharge space 24, and which contain at least silicon (Si), carbon (C), or cerium (Ce) is 0.6 ng/cm$^2$ or less. Thus, in the excimer discharge lamp 1 according to the first embodiment, since the electric discharge container 2 is made of sapphire, YAG, or single crystal yttria which has low reactivity with halogen or halide, and since the quantity of the impurities which exist in the inner surfaces 25 of the electric discharge space 24 and which contain at least silicon (Si), carbon (C), or a cerium (Ce) is very small, time (the so-called life span) during which the relative intensity with respect to the initial light intensity at time of initial lighting decreases to 50% can be lengthened so that the life span thereof may be tens of hours.

Furthermore, in the excimer discharge lamp 1 according to the first embodiment, since the quantity of the impurities which exists in the inner surface 25 of the electric discharge container 2 forming electrical discharge space 24 and which contain at least silicon (Si), carbon (C), or cerium (Ce), is 0.6 ng/cm$^2$ or less, it is possible to suppress manufacture variation, as shown in a experimental result described below.

As shown in FIG. 1, in the first embodiment, the pair of plates 21 is formed in the shape of a rectangular parallelepiped. However, in the present invention, the shape thereof is not limited to such a rectangular parallelepiped. Description of such an example will be given referring to FIG. 3.

Figure 3:
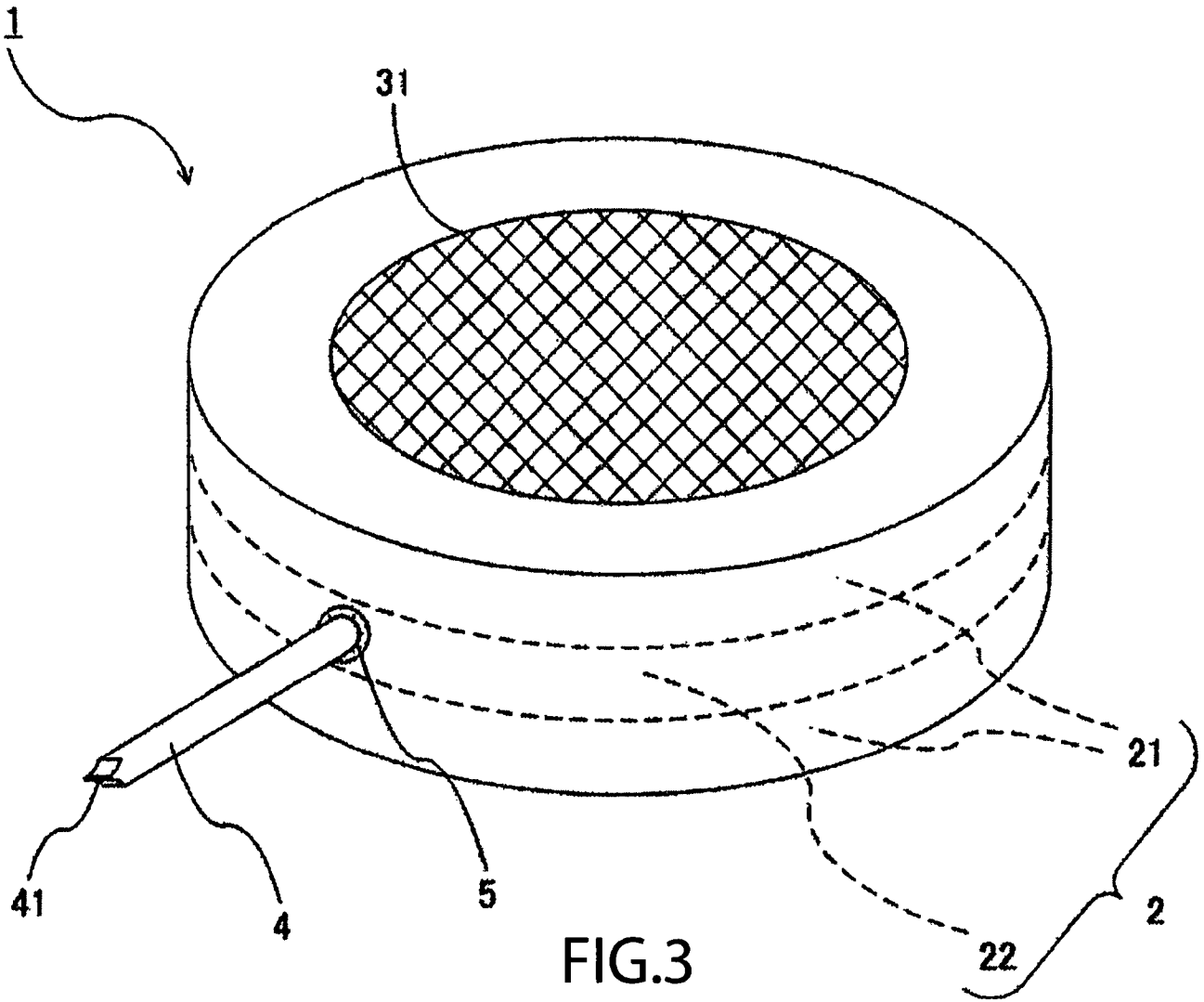
FIG. 3 is an explanatory diagram of an excimer discharge lamp according to a second embodiment.

FIG. 3 is an explanatory perspective view of an excimer discharge lamp 1 according to a second embodiment. In addition, in FIG. 3, the same numerals as those of FIGS. 1 and 2 are assigned to the same elements as those shown in FIGS. 1 and 2.

The second embodiment shown in FIG. 3 is different from the first embodiment shown in FIGS. 1 and 2, in that in the second embodiment, the shape of a pair of plates 21 is disk-like, and a side wall 22 is annular. In a description of the second embodiment shown in FIG. 3, explanation of portions which are common to the above embodiments is omitted, so that portions different from those of the first embodiment will be given below.

In the excimer discharge lamp 1 according to the second embodiment, a pair of plates 21 is in shape of a disk, and a side wall 22 is annular. The electric discharge container 2 is made up of the pair of plates 21, and the side wall 22. A sealed electrical discharge space 24 (not shown) is formed inside the electric discharge container 2. Thus, even if the pair of plates 21 according to second embodiment is in the shape of a disk, the function as a surface light source is achieved, and the same action and effect as those of the first embodiment can be obtained.

Next, a method of making the excimer discharge lamp 1 according to the first embodiment is explained as a third embodiment.

Figure 7:
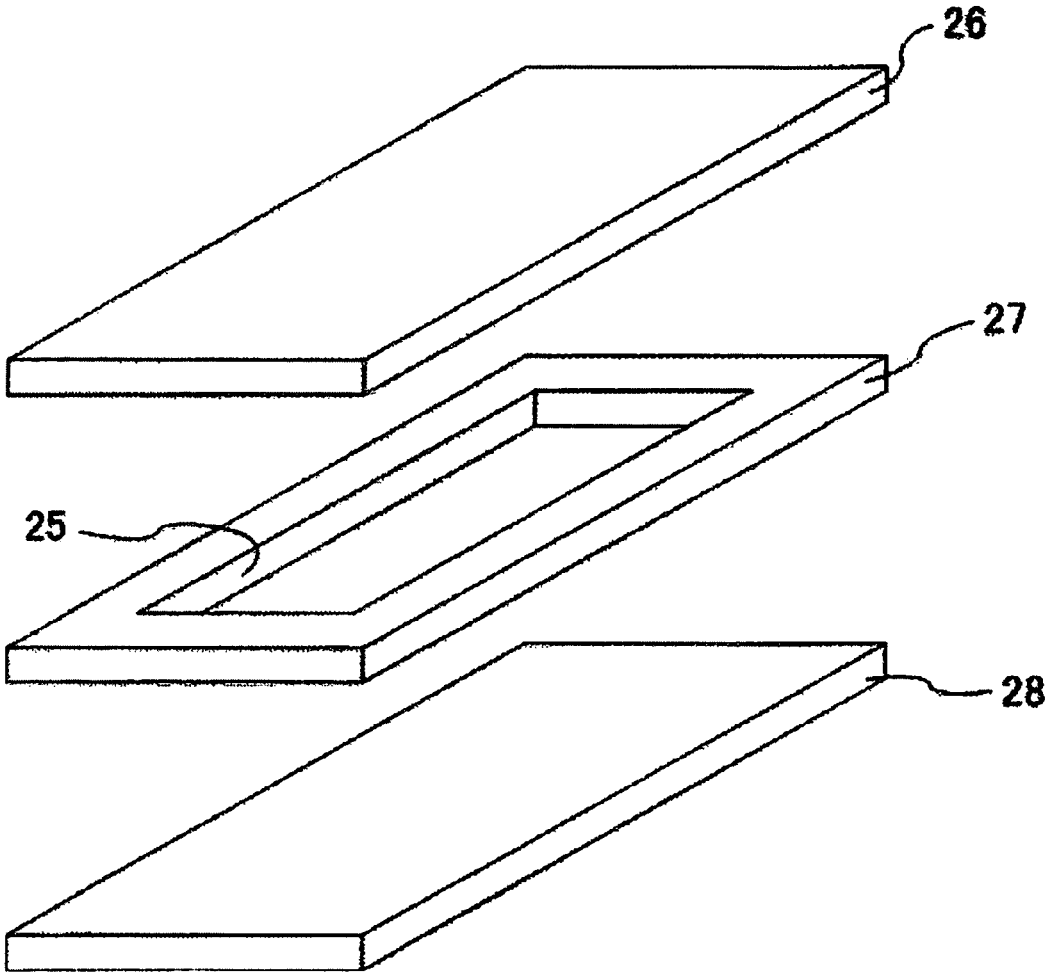
FIG. 7 is an explanatory diagram for a subject matter.

FIGS. 4A, 4B, 4C and 4D are explanatory diagrams for the manufacturing method of an excimer discharge lamp 1, according to the third embodiment. FIG. 4A is a top plan view showing the manufacturing method, in which a pair of plates 26 and 28 and a side wall member 27 are fixed to a jig 61. FIG. 4B is a cross sectional view thereof, (a cross sectional view taken along IVB-IVB of FIG. 4A) showing a step of grinding the pair of plates 26 and 28 and the side wall member 27 shown in FIG. 4A. FIG. 4C is a perspective view thereof, showing a step of heating while pressing the pair of plates 26 and 28 and the side wall member 27 after grinding them in FIG. 4B. FIG. 4D is a perspective view thereof, showing a step of cleaning the inner surfaces 25 of the electric discharge container 2, which has been joined in the process shown in FIG. 4C, with chemical etching liquid 69. In addition, in FIGS. 4A, 4B, 4C, and 4D, the same numerals as those of FIGS. 1, 2 and 7 are assigned to the same elements as those shown in FIGS. 1, 2 and 7.

For example, the three plate members 26, 27, and 28 made of sapphire are prepared, and a rectangular hole is formed in one of the plate members 27 so as to penetrate a central part thereof, thereby forming the annular side wall member 27. As shown in FIG. 4A, for example, when a surface of the one side wall member 27 in the front side of FIG. 4A is to be ground, the side wall member 27 is arranged on a support stand (it is indicated as "63" in FIG. 4B, although not shown in FIG. 4A), so that the surface to be ground may be located in the front side of FIG. 4A. Since a jig 631 for a hole is provided on the support stand (In FIG. 4B, it is indicated as 63 although not shown in FIG. A), the side wall member 27 is arranged on the support stand so that the jig 631 for a hole may be located at the center hole. Then, two plate members 26 and 28 are arranged on the right and left of the side wall member 27 in a state where surfaces to be ground face a front side of FIG. 4A. The two plate members 26 and 28 and the one side wall member 27 are covered by the jig 61 and an adhesive agent 62 in the outer circumference thereof, so that they are fixed to the support stand (In FIG. 4B, it is indicated as 63 although not shown in FIG. 4A).

As shown in FIG. 4B, the two plate members 26 and 28 and the one side wall member 27 which have been fixed therein as shown in FIG. 4A, are placed so that surfaces thereof to be ground (surfaces thereof in a lower side of FIG. 4B) face a grinding stand 64.

In the grinding process, in order to perform three grinding steps, the so-called a "grinding" step, a rapping" step, and a "polishing" step, the grinding stand 64 and the particle size of the abrading agent 67 are changed in each step of the grinding process. First, in the "grinding" step of the grinding process, steel is used as the grinding stand 64. The surfaces of the two plate members 26 and 28 and the one side wall member 27, which face the grinding stand 64 are ground by unevenness of the grinding stand 64, and the abrading agent 67, for example, silicon dioxide ($SiO_2$), silicon carbide (SiC), diamond (C), or cerium oxide ($CeO_2$) supplied between the surfaces to be ground by an abrading agent supply unit 66 and the grinding stand 64. Next, a surface in an opposite side to the ground surface of the at least one side wall member 27, (a surface in an upper side of FIG. 4B) is ground. Then, in the "rapping" step of the grinding process, tin is used as the grinding stand 64. The surfaces of the two plate members 26 and 28 and the one side wall member 27, which face the grinding stand 64 are again ground by unevenness of the grinding stand 64, and the abrading agent 67, for example, silicon dioxide ($SiO_2$), silicon carbide (SiC), diamond (C), or cerium oxide ($CeO_2$) supplied between the surfaces to be ground by the abrading agent supply unit 66 and the grinding stand 64. The particle size of the abrading agent which is used at this time is smaller than that of the abrading agent which is used at the time of the "grinding" step. Next, a surface of the at least one side wall member 27, which is in an opposite side of the ground surface (a surface in a upper side of FIG. 4B), is again ground. Finally, in the "polishing" step of the grinding process, aluminum to which resin is applied is used as the grinding stand 64. As to the two plate members 26 and 28 and the one side wall member 27, the surfaces thereof which face the grinding stand 64 are ground again by the abrading agent 67, for example, silicon dioxide ($SiO_2$), silicon carbide (SiC), diamond (C), and cerium oxide ($CeO_2$) which is supplied between the surface to be ground with the abrading agent supply unit 66, and the resin of the grinding stand 64. The particle size of the abrading agent used at this time is smaller than that of the abrading agent used at the time of the "rapping" step.

Next, a surface of the at least one side wall member 27, which is in an opposite side of the ground surface (a surface in an upper side of FIG. 4B), is again ground. Thus, the two plate members 26 and 28 and the one side wall member 27 pass through the three grinding steps of the "grinding" step, the "wrapping" step, and the "polishing" step, whereby the particle size of the abrading agent 67 becomes gradually smaller, so that the smoothness of the ground surface can be improved. In addition, although it is possible to suppress the abrading agent 67 from infiltrating into the inner surfaces 25 which forms the hole of the side wall member 27 since the jig 631 for a hole which is provided on the support stand 63 is arranged in the hole of the side wall member 27, since the shape of the inner circumference surface of the side wall member 27 varies due to manufacture variation, so that the shape thereof is not always completely the same, whereby infiltration of the abrading agent 67 cannot be completely prevented.

After grinding the two plate members 26 and 28 and the one side wall member 27 in FIG. 4B, the ground surfaces thereof are brought into contact with each other so that the two plate members 26 and 28 may be arranged so as to face each other through the one side wall member 27, and so that the laminated members are formed.

Description thereof will be given below referring to FIG. 4C. One of the ground surfaces of the side wall member 27 is brought into contact with the ground surface of the plate member 26 (a surface in an upper side of FIG. 4C). Moreover, the other ground surface of the plate member 28 is brought into contact with the other ground surface of the side wall member 27 (a surface in a lower side of FIG. 4C), so that the hole of the side wall member 27 may be surrounded by the pair of plates 26 and 28. The exterior surfaces of the pair of plates 26 and 28 (the surface in an upper side of one of the plate members 26 of FIG. 4C and the surface in a lower side of the other plate member 28 of FIG. 4C) are pressed by a pressing unit 68 (not shown), so that the ground surfaces of the two plate members 26 and 28 and the one side wall member 27 are respectively brought into close contact with each other in the state where they are laminated. While the two plate members 26 and 28 and the one side wall member 27 are laminated and pressed, they are heated at, for example, 1300-1400 degrees Celsius for 8 to 15 hours under reduced pressure.

After heating in FIG. 4C, the surfaces of the two plate members 26 and 28 and the one side wall member 27 are cooled to room temperature, and the surfaces which are respectively brought into contact with each other are joined to each other, thereby forming an integrated member so as to serve as the electric discharge container 2. The abrading agent 67 used in the grinding process, which is shown in FIG. 4B, remains on the inner circumference face of the electric discharge container 2 made in the step of FIG. 4C. This abrading agent 67 has the high reactivity with halogen ions at time of lamp lighting, thereby causing the short life span of the excimer discharge lamp 1. For this reason, in the cleaning process shown in FIG. 4D, the abrading agent 67 which remains on the inner circumference face of the electric discharge container 2 is dissolved, so as to be removed. Specifically, the electrical discharge space 24 made from the inner surfaces 25 is formed in the electric discharge container 2, and a through hole 23 which leads to the electrical discharge space 24 is provided in the side wall 22 (the side wall member 27 before joining them) which forms the electric discharge container 2. In a room temperature state, chemical etching liquid 69 which consists of at least one of hydrogen fluoride, sulfuric acid, or nitric acid, is introduced in the electrical discharge space 24 from the through hole 23 so that it is filled up with the chemical etching liquid 69. The impurities which contains, for example, at least one of carbon (C), silicon (Si), and cerium (Ce), which form the abrading agent 67, are dissolved so that the inner surfaces 25 of the electric discharge container 2 is washed by this chemical etching liquid 69. At this time, in order that the quantity of the impurities containing at least silicon (Si), carbon (C), or a cerium (Ce), which exists in the inner surface 25 of the electric discharge container 2, may be 0.6 $ng/cm^2$ or less, it is necessary to fill up the chemical etching liquid 69 therein for a long time in a room temperature state, so as to dissolve the impurities. In order that the quantity of impurities may be 0.6 $ng/cm^2$ or less for a short time, the electric discharge container 2 is soaked in warm water whose temperature is 60 degree Celsius, and the electric discharge container 2 is filled up with the chemical etching liquid 69, thereby washing the inner surface 25 of the electric discharge container 2.

In the electric discharge container 2 which has been washed in FIG. 4D, a tube member 4 shown in FIG. 1 is bonded to the through hole 23 with a wax material 5. The tube member 4 has a hole which extends in a central axis thereof, and this hole leads to the electrical discharge space 24. For this reason, as gas for light emission, rare gas such as argon (Ar), krypton (Kr), and xenon (Xe) and halogen such as fluorine ($F_2$), chlorine ($Cl_2$), bromine ($Br_2$), and iodine ($I_2$) or halide such as sulfur hexafluoride ($SF_6$) are enclosed in the electrical discharge space 24 through the hole of the tube member 4. A sealing portion 41 is formed by pressure-welding one end of the tube member 4 (an end portion in the front side of FIG. 1), so that the inside of the electrical discharge space 24 is sealed airtightly. After printing is performed so as to form a net like pattern by applying a past of, for example, copper onto the pair of exterior surfaces of the electric discharge container 2 which face each other, the past form copper which is applied on the exterior surfaces is heated together with the electric discharge container 2 to high temperature, and the net-like external electrodes 31 and 32 are formed by calcinating the paste form copper. Thereby, the excimer discharge lamp 1 is completed.

In addition, although in the above-description, sapphire is used as material which forms the electric discharge container, YAG and single crystal yttria can be also joined to each other in the above-mentioned joining method. Since YAG and single crystal yttria have ultraviolet-rays permeability like sapphire, they can be used as material which forms the electric discharge container according to the present invention.

According to the third embodiment, the method of making the excimer discharge lamp 1, comprises a step of grinding surfaces of two plates 26 and 28 and the side wall 27, which are joined to each other; a step of joining the surfaces by heating while the surfaces to be joined to each other is pressed so as to be brought into contact with each other, after the step of grinding the surfaces; and a step of washing the inner surface 25 of the electric discharge container 2, which has been made in the step of joining the surfaces, with chemical etching liquid. Among these steps, in the steps of grinding and joining the two plate members 26 and 28 and the one side wall member 27, the electric discharge container 2 which forms the electrical discharge space 24 can be formed with only material having low reactivity with halogen or halide. Moreover, the impurities which exist in the inner surfaces 25 of the obtained electric discharge container 2, and which contain at least silicon (Si), carbon (C), or cerium (Ce) having high reactivity halogen or halide, can be removed according to the washing step. Since the third embodiment includes such three steps, the electric discharge container 2 of the excimer discharge lamp 1 manufactured thereby is made of sapphire, YAG, or single crystal yttria having low reactivity with halogen or halide, and since the quantity of the impurities which exist in the inner surface 25 of the electrical discharge space 24 and which contain at least silicon (Si), carbon (C), or cerium (Ce) is very small, time (the so-called life span) during which the relative intensity with respect to the initial light intensity at time of initial lighting decreases to 50% can be lengthened so that the life span thereof may be tens of hours.

Furthermore, in the manufacture method according to the third embodiment, the quantity of the impurities which exist in the inner surface 25 of the electric discharge container 2 which forms the electrical discharge space 24, and which contain at least silicon (Si), carbon (C), or cerium (Ce), is set to 0.6 ng/cm$^2$ or less, so that it is possible to suppress manufacture variation, as shown in an experimental result described below.

In addition, although the joining step is performed after the grinding step, and the washing step is finally performed by the above-mentioned manufacture method, the washing step may be performed after the grinding step and then the joining step may be performed. In this case, in the washing step, for example, carbon (C), silicon (Si), or cerium (Ce) which forms the abrading agent 67 adhering to the surfaces is dissolved by dipping the ground two plate members 26 and 28 and the one side wall member 27 in chemical etching liquid.

Moreover, although the through hole 23 which leads to electrical discharge space 24 is provided in the electric discharge container 2, this through hole 23 may be formed in the side wall member 27 before the grinding step, or may be formed in the side wall member 27 after the grinding step, and further may be formed in the side wall 22 of the electric discharge container 2 obtained after the joining step.

The structure and the manufacture method of the excimer discharge lamp 1 according to the present invention are described above. Next, an experiment for confirming the effect of the excimer discharge lamp 1 according to the present invention will be explained.

Excimer discharge lamps 1 used for the experiment were produced, according to the manufacture method explained referring to FIGS. 4A, 4B, 4C and 4D, so that fourteen lamps as shown in FIGS. 1 and 2 were prepared. In the fourteen prepared excimer discharge lamps, the quantity of the impurities which existed in the inner surface 25 of the electric discharge container 2, and which contained at least silicon (Si), carbon (C), or cerium (Ce) 1 differed from one another, although the other structure was the same. First, specification of the fourteen excimer discharge lamps 1 common to one another will be explained.

Sapphire was used as material which forms the electric discharge containers 2, wherein gas which consists of argon was enclosed in the respective electrical discharge spaces 24. The tube member 4 provided in the through hole of the electric discharge container 2 consists of nickel (Ni), and wax material 5 which attaches the tube member 4 to the through hole consists of an alloy of silver and copper (Ag—Cu alloy). The specification (numerical value) of the excimer discharge lamps 1 used for the experiment is set forth below. The width of the electric discharge container 2 (the length thereof in left and right directions in FIG. 1) was 4 cm. The depth of the electric discharge container 2 (the length thereof in front and back directions in FIG. 1) was 6 cm. The height of the electric discharge container 2 (the length thereof in upper and lower directions of FIG. 1) was 1 cm. Moreover, the area on the inner surface 25 which formed the electrical discharge space 24 was 40 cm$^2$, and the volume of the electrical discharge space 24 was 9 cm$^3$.

In the grinding step of the method of making the electric discharge container 2, the abrading agent 67 which consisted of slurry of silicon dioxide was used, and the chemical etching liquid 69 which consisted of hydrogen fluoride thereof was used in the washing step.

Next, differences of the fourteen excimer discharge lamps 1 in the specification will be explained. The quantity of the impurities which existed in the inner surface 25 of the electric discharge container 2 and which contained at least silicon (Si), carbon (C), or cerium (Ce) was changed, by shortening or lengthening a period during which the electric discharge container 2 of each excimer discharge lamp 1 was filled up with chemical etching liquid, in the washing step, In the experiment, voltage of 7 kV with high frequency of 70 kHz was impressed to a pair of external electrodes 31 and 32 of the excimer discharge lamp 1, and time for the relative intensity with respect to the desired light intensity at time of initial lighting of the excimer discharge lamp 1, to decrease to 50% thereof, was measured. Each lamp was turned off, when the relative intensity became 50% thereof. The wax material 5 and the tube member 4 were removed from the lamp which was turned off, so as to be in a state as showed in FIG. 4D, and the inner surface 25 of the electric discharge container 2 was washed for a long time in the state of room temperature or at high temperature, using the hydrogen fluoride which was the chemical etching liquid 69. The impurities which existed in the inner surface 25 of the electric discharge container 2 and which contained at least silicon (Si), carbon (C), or cerium (Ce) was contained in the chemical etching liquid 69 which was collected after this washing. For this reason, the contained amount of the impurities which contained at least silicon (Si), carbon (C), or cerium (Ce) was measured from the chemical etching liquid 69 which was collected after washing, by an ICP (Inductively Coupled Plasma) spectral-analysis method.

Figure 5:
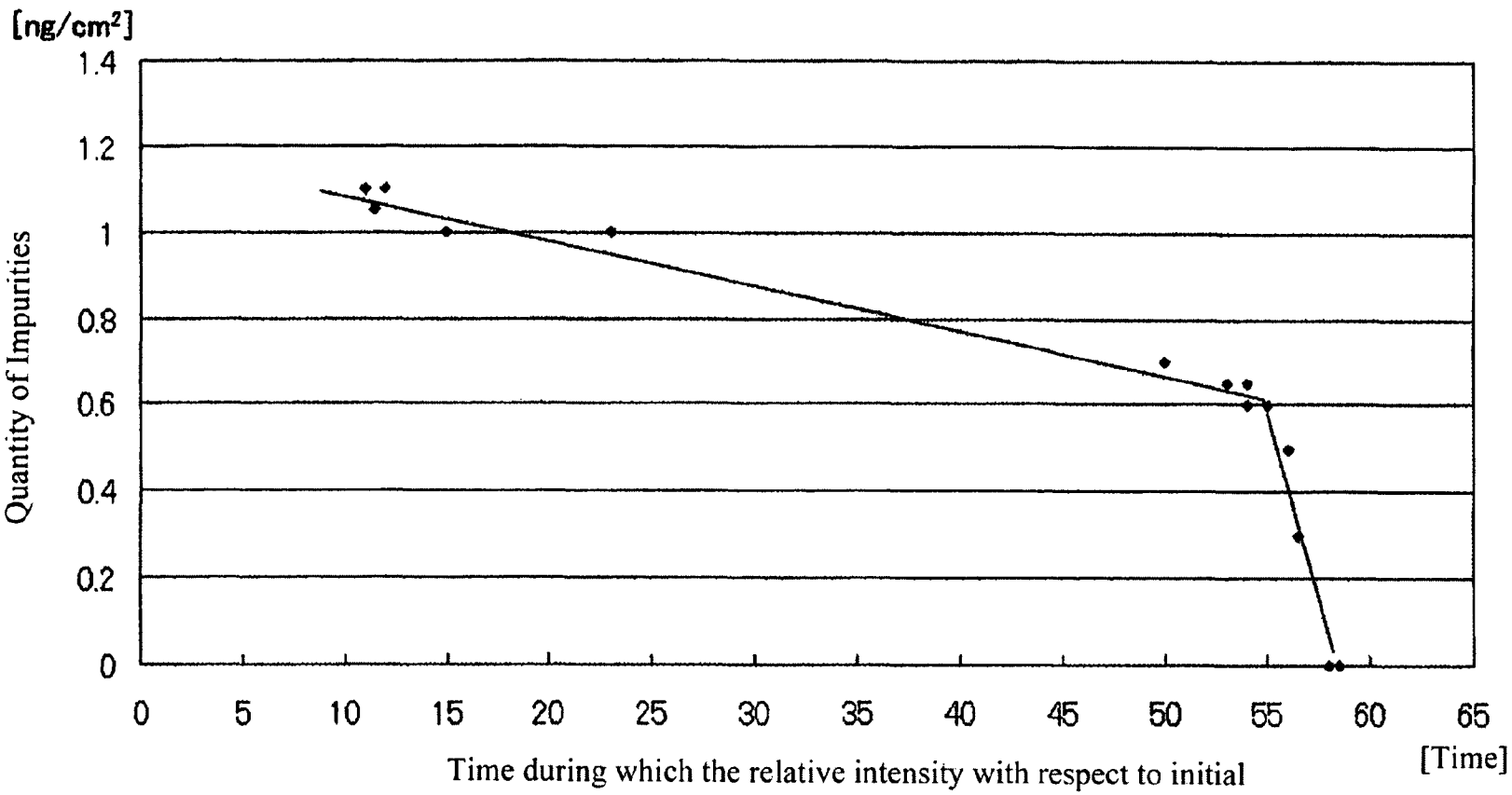
FIG. 5 shows an experimental result.

FIG. 5 is a graph showing the result of the experiment. In FIG. 5, the horizontal axis of the graph shows time for the relative intensity with respect to the desired light intensity at time of initial lighting, to decrease to 50% thereof, and the vertical axis shows the quantity of the impurities which existed in the inner surface 25 of the electric discharge con tainer 2 and which contained at least silicon (Si), carbon (C), or cerium (Ce).

Figure 6:
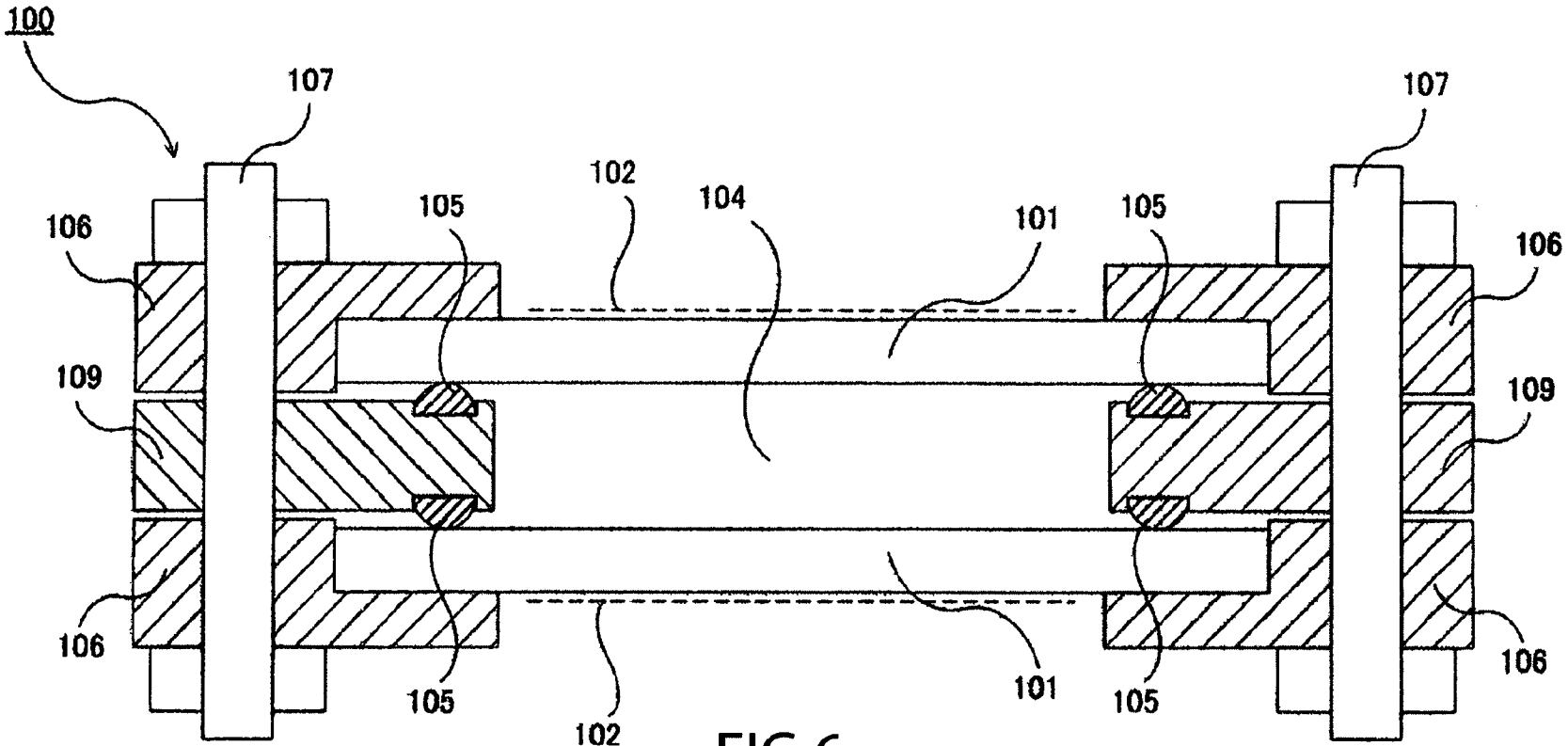
FIG.6 PRIOR ART
FIG. 6 shows an explanatory diagram of a conventional excimer discharge lamp.

As shown in FIG. 5, in the excimer discharge lamp 1 having the structure according to the embodiments described above, time (the life span thereof) for the relative intensity with respect to the desired light intensity at the initial lighting, to decrease to 50% thereof, was 10 hours or more. It turned out that the excimer discharge lamp 1 according to the present invention had the life span much longer than the life span of the conventional excimer discharge lamp 1 shown in FIG. 6, which was several hours.

Furthermore, the following are also found from FIG. 5. In the lamp, in which the quantity of the impurities existing in the inner surface 25 of an electric discharge container, and containing at least silicon (Si), carbon (C), or cerium (Ce) was more than 0.6 ng/cm$^2$, there was a wide variation in time during which the relative intensity decreased to 50% thereof, that is, 45 hour variation of 10 to 55 hours. On the other hand, in the lamp in which the quantity of the impurities was 0.6 ng/cm$^2$ or less, there was a little variation in time during which the relative intensity decreases to 50% thereof, that was 3 hour variation of 55 to 58 hours. That is, it turned out that when the quantity of the impurities which existed in the inner surface 25 of the electric discharge container 2 and which contained at least silicon (Si), carbon (C), or cerium (Ce) was set to 0.6 ng/cm$^2$ or less, it was possible to make the life span longer than the conventional discharge lamp, and to suppress manufacture variation.

As shown in the above-mentioned experiment, the electric discharge container 2 of the excimer discharge lamp 1 according to the present invention had the sealed electrical discharge space 24 which was formed by the pair of plates 21 and the side wall 22 connected to the pair of plates 21, wherein the pair of plates 21 and the side wall 22 were made of sapphire, YAG, or single crystal yttria, and wherein the quantity of the impurities existing in the inner surface 25 of the electric discharge container 2 which surrounds the electrical discharge space 24, and containing at least silicon (Si), carbon (C), or cerium (Ce) was 0.6 ng/cm$^2$.

The preceding description has been presented only to illustrate and describe exemplary embodiments of the present excimer discharge lamp and method of making the same. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. An excimer discharge lamp comprising:

an electric discharge container including a pair of plates which face each other, wherein an electrical discharge space is formed between the pair of the plates;

a pair of external electrodes provided on exterior surfaces of the pair of the plates; and a light emission gas which is enclosed in the electrical discharge space, wherein the light emission gas is at least one selected from a group consisting essentially of rare gas and halogen, and halide;

wherein the electrical discharge space of the electric discharge container is sealed by the pair of the plates and a side wall which connects the pair of the plates, wherein the pair of the plates and the side wall are made of at least one of a group consisting essentially of sapphire, YAG, and single crystal yttria, wherein impurities which exist in an inner surface of the electric discharge container surrounding the electrical discharge space consist of at least one of silicon, carbon and cerium; and the quantity of the impurities is 0.6 ng/cm$^2$ or less.

2. A manufacture method of the excimer discharge lamp according to claim 1, the manufacturing method comprising the following steps of:

grinding surfaces of the pair of the plates and an annular side wall, the plates and the side wall are made of one selected from a group consisting essentially of sapphire, YAG, and single crystal yttria;

arranging the side wall between the pair of the plates, after the step of grinding the surfaces;

joining the ground surfaces by heating the ground surfaces while the ground surfaces being pressed to each other to form the electric discharge container having the electrical discharge space by the pair of plates and the side wall;

introducing chemical etching liquid from a through hole into the electrical discharge space of the electric discharge container thereby cleaning an inner surface of the electric discharge container.

3. A manufacture method of the excimer discharge lamp according to claim 1, comprising the following steps of:

grinding surfaces of the pair of the plates and the side wall;

arranging the side wall between the pair of the plates;

joining the surfaces by heating the surfaces while the surfaces being pressed to each other to form the electric discharge container;

introducing chemical etching liquid from a through hole into the electrical discharge space thereby cleaning an inner surface of the electric discharge container.

4. A manufacture method of the excimer discharge lamp according to claim 3, wherein the manufacture method further comprising, after the grinding step, rapping and polishing the surfaces.

5. A manufacture method of the excimer discharge lamp according to claim 3, wherein the manufacture method further comprising a step of forming the through hole.

* * * * *